US008066347B2

(12) United States Patent
Tamura et al.

(10) Patent No.: US 8,066,347 B2
(45) Date of Patent: Nov. 29, 2011

(54) RECORDING ELEMENT SUBSTRATE, RECORDING HEAD, AND INK JET RECORDING APPARATUS HAVING THE RECORDING HEAD

(75) Inventors: Hideo Tamura, Kawasaki (JP); Yoshiyuki Imanaka, Kawasaki (JP); Koichi Omata, Kawasaki (JP); Takaaki Yamaguchi, Yokohama (JP); Kousuke Kubo, Yokohama (JP); Ryoji Oohashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 351 days.

(21) Appl. No.: 12/418,972

(22) Filed: Apr. 6, 2009

(65) Prior Publication Data

US 2009/0273629 A1 Nov. 5, 2009

(30) Foreign Application Priority Data

Apr. 30, 2008 (JP) ..... 2008-118411

(51) Int. Cl.
*B41J 29/38* (2006.01)
*B41J 29/393* (2006.01)

(52) U.S. Cl. ..... 347/17; 347/19

(58) Field of Classification Search ..... 347/17, 347/19

See application file for complete search history.

(56) References Cited

U.S. PATENT DOCUMENTS

| | | | | |
|---|---|---|---|---|
| 6,945,629 | B2 | 9/2005 | Yamaguchi et al. | |
| 7,201,461 | B2 * | 4/2007 | Kim et al. | 347/17 |
| 7,344,218 | B2 * | 3/2008 | Imanaka et al. | 347/19 |
| 7,441,878 | B2 | 10/2008 | Iijima | |
| 2002/0149657 | A1 | 10/2002 | Ishinaga et al. | |
| 2003/0081033 | A1 * | 5/2003 | Giere et al. | 347/17 |
| 2005/0179745 | A1 | 8/2005 | Yamaguchi et al. | |
| 2005/0231925 | A1 * | 10/2005 | Fukuda et al. | 361/760 |

* cited by examiner

*Primary Examiner* — Matthew Luu
*Assistant Examiner* — Jannelle M Lebron
(74) *Attorney, Agent, or Firm* — Fitzpatrick, Cella, Harper & Scinto

(57) ABSTRACT

Measurement accuracy in temperature of a substrate for an ink jet head is improved. A substrate for an ink jet head includes diode sensors and aluminum sensors and as plural kinds of substrate temperature sensing elements, each of which has an output voltage property different from each other. The diode sensors and have a property that the output voltage thereof decreases as temperature increases when a constant current is applied to the corresponding sensor. The aluminum sensors and have a property that the output voltage thereof increases as temperature increases when the constant current is applied to the corresponding sensor.

12 Claims, 7 Drawing Sheets

RECORDING ELEMENT SUBSTRATE, RECORDING HEAD, AND INK JET RECORDING APPARATUS HAVING THE RECORDING HEAD

BACKGROUND OF THE INVENTION

1. Field of the Invention

The present invention relates to a recording element substrate used in an ink jet head which performs recording by discharging ink droplets from discharging ports. The present invention further relates to a recording head having such a recording element substrate and an ink jet recording apparatus having such a recording head.

2. Description of the Related Art

A substrate for an ink jet head includes heaters (heating elements), drivers, a logic circuit, a substrate temperature sensing element, pads (external electrode terminals) and the like.

The heaters generate thermal energy for discharging ink. The drivers drive the heaters. The logic circuit controls the drivers. The substrate temperature sensing element senses a substrate temperature. The pads are used for electrical connection with the ink jet head or the ink jet recording apparatus.

The heaters are formed such that the number of the heaters is compatible with that of discharging ports. Therefore, the number of the drivers is also formed compatibly with that of the discharging ports. Such a substrate for an ink jet head is monolithically fabricated on a silicon semiconductor substrate through semiconductor device manufacturing techniques.

In addition, such an ink jet head is characterized in that temperature is closely related to a diameter and a discharging speed of an ink droplet, which affects an image density and exert an influence upon printing quality. Therefore, sensing of the substrate temperature plays an important role.

As a substrate temperature sensing element which is provided on a substrate for an ink jet head, a diode sensor and an aluminum sensor are adopted therein, each of which is formed on a silicon substrate through semiconductor manufacturing techniques.

The diode sensor senses temperature in accordance with temperature properties of forward voltage in a semiconductor diode. In addition, the aluminum sensor senses temperature in accordance with change in a resistance value caused by change in temperature.

Here, comparing the diode sensor and the aluminum sensor, the properties of the diode sensor are stable even if deviation in manufacturing processes is considered. On the other hand, in the aluminum sensor, the deviation occurs in the resistance value according to a film thickness and a line width of aluminum in manufacturing processes. For this reason, the diode sensor is excellent in view of the accuracy of the temperature sensing. In addition, in the aluminum sensor, high electrical resistance is required, and the line width has to be increases in order to reduce the deviation in processes. Therefore, such problem is dealt with by lengthening a layout distance of the aluminum sensor. The configurations proposed in U.S. Application Laid-open. No. 2002/0149657 or U.S. Pat. No. 6,945,629 have been known as a prior art for the above-mentioned techniques. In addition, U.S. Pat. No. 7,441,878 discloses a configuration such that temperature sensors are disposed at plural places of a substrate.

Sensing of a substrate temperature is important in order to enhance resolution in printing quality and an ink jet head is required to be long according to increase in printing speed. For this reason, the substrate for the ink jet head is configured to include the heaters to be arranged in a longitudinal direction of the substrate. At the same time, it is important that temperature measurement can be performed on a plurality of places including the vicinity of the center portion of the heater array as well as the temperature measurement is performed in the vicinity of end portions of the conventional heater array.

However, when the diode sensors for measuring the temperature near the end portion of the heater array are disposed not only on the end portion of the heater array but also on the center portion of the heater array to measure the temperature, the following problem occurs. That is, there is a problem in that sensitivity in the temperature measurement of the diode sensor which is disposed on the center portion of the heater array is degraded.

The causes of the problem are as follows.

FIG. 8 is a cross-sectional view schematically illustrating the diode sensor. In FIG. 8, a diode for sensing the temperature is formed to have a PN junction structure which is schematically illustrated as a diode 206. That is, in order to form the diode for sensing the temperature, a p-type region 202 and an n-type region 203 are formed on a p-type semiconductor substrate 201, and an $n^+$ region 204 and a $p^+$ region 205 are formed within the n-type region 203.

When such a structure of a temperature sensor is used, a constant current is supplied from the $p^+$ region 205 serving as an anode to the $n^+$ region 204 serving as a cathode. At this time, by monitoring a forward voltage (Vf), change in temperature can be sensed because Vf has a temperature property of about −2 to −2.5 mV/° C.

The relationship between the change in temperature and an output voltage at the time of applying the constant current to the diode sensor has the feature illustrated in FIG. 9. That is, in the diode sensor, the output voltage decreases as the temperature increases.

In contrast, the relationship between the change in temperature and the output voltage at the time of applying the constant current to an aluminum wiring for electrically connecting the diode sensor or an aluminum sensor has the feature illustrated in FIG. 10. That is, in the aluminum wiring or the aluminum sensor, the output voltage also increases as the temperature increases.

Here, in order to dispose the diode sensor in the vicinity of the center portion of the heater array, first, the diode sensor is disposed in the vicinity of the center portion of the heater. Further, it is necessary to make longer the aluminum wiring from an input/output pad to the diode sensor in order to electrically connect the input/output pad and the diode sensor.

With the configuration described above, in terms of a value of the output voltage for sensing the temperature at the time of applying the constant current, when the temperature increases, a value of the output voltage of the diode sensor unit decreases, and on the contrary, a value of the output voltage of the aluminum wiring unit increases. That is, the values of the output voltages are changed so as to be canceled to each other. For this reason, an amount of change in temperature is sensed smaller than an actual amount of change, so that the sensitivity becomes degraded.

As a result, since accuracy of the temperature sensing in a high temperature of the ink jet head is lowered, it is impossible to properly perform driving control and the printing quality is often degraded due to variation in an image density.

SUMMARY OF THE INVENTION

The present invention has been made in view of the above problems, and an object is to provide a substrate for an ink jet head which can solve the problems in the related background art.

A recording element substrate of the present invention includes: a plurality of recording element arrays; a liquid supply port which supplies a liquid for recording to the plurality of the recording element arrays; a logic circuit for driving the plurality of the recording element arrays; a plurality of temperature sensing elements for sensing temperature; and a terminal for inputting or outputting a signal to the logic circuit, all of which are formed on the same substrate, wherein the plurality of the temperature sensing elements have an output voltage property different from each other, and include a temperature sensing element having a property that an output voltage thereof decreases as a temperature of the recording element substrate increases and a temperature sensing element having a property that the output voltage increases as the temperature of the recording element substrate increases.

According to the present invention, the accuracy of measurement of the recording element substrate can be improved.

Further features of the present invention will become apparent from the following description of exemplary embodiments with reference to the attached drawings.

DESCRIPTION OF THE EMBODIMENTS

In the following, embodiments of the present invention will be described with reference to the accompanying drawings.

Figure 1:
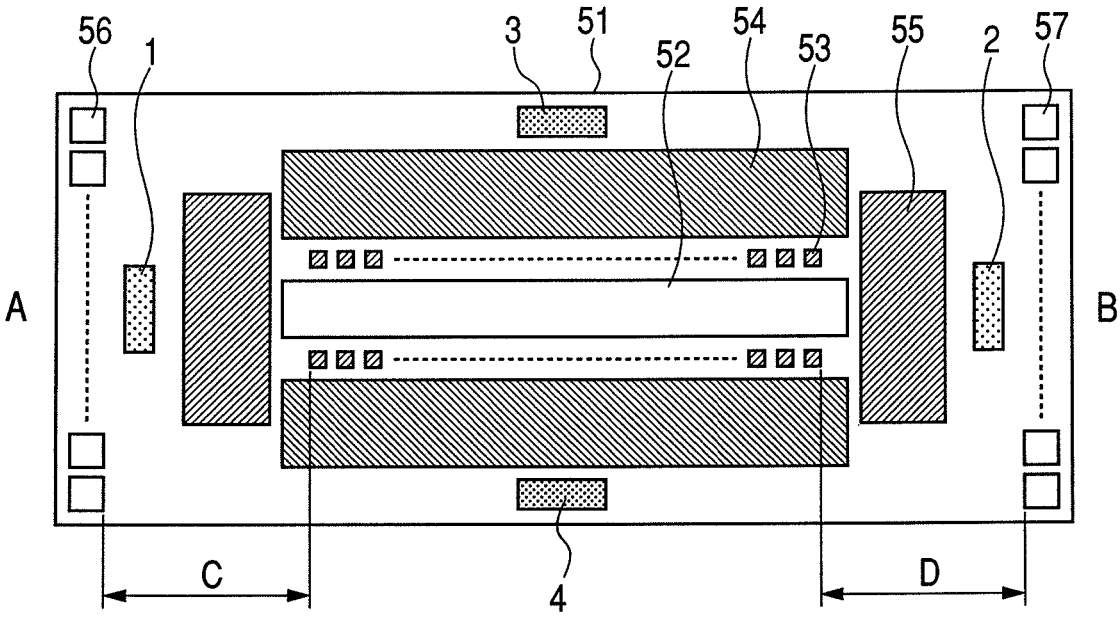
FIG. 1 is a plan view illustrating a substrate for an ink jet head of the present invention.

FIG. 1 is a plan view illustrating a substrate for an ink jet head according to an embodiment of the present invention.

A substrate 51 for an ink jet head includes circuits which are formed on (built-in) a silicon semiconductor substrate or the like through semiconductor device manufacturing techniques. The substrate 51 has a substantially rectangular shape, and in the center portion, includes an ink supply port 52 formed as a substantially rectangular through hole which is extended in a longitudinal direction of the substrate.

A plurality of heaters 53 as a recording element is provided along the both side of the ink supply port 52. The heaters 53 is formed on one surface (hereinafter, refer to as a front surface) of the substrate 51 for the ink jet head. A liquid (ink) is supplied from a side of the other surface (hereinafter, refer to as a rear surface) of the substrate 51 through the ink supply port 52 and heated to form bubbles. Then, ink droplets are discharged through discharging ports (not shown in FIG. 1) which are provided to face the heaters 53.

A driver unit 54 is provided on an opposite side of the ink supply port 52 in a state of interposing the heaters 53. The driver unit 54 includes drivers for driving the respective heaters 53. Each of the drivers is typically provided for the respective heater 53 and is made of transistors for switching.

In addition, the substrate 51 for the ink jet head includes a logic circuit unit 55 and a pad unit for supplying power source as a terminal and signals to the substrate for the ink jet head from a main body of a recording apparatus. The logic circuit unit 55 and the pad unit are formed on the end portion of the substrate 51 for the ink jet head in a longitudinal direction.

The pad unit includes a plurality of pads 56 and 57 and is used to electrically connect the circuits on the substrate with the main body of the ink jet recording apparatus by using electrical connection means such as a wire bonding.

The logic circuit unit 55 includes logic circuits for controlling, when signals are given from the main body of the recording apparatus via the pads 57, ON/OFF of each transistor in the driver unit 54 according to the signals.

In addition, the substrate 51 includes diode sensors 1 and 2 and aluminum sensors 3 and 4 as a plurality of kinds of temperature sensing elements, each of which has a different output voltage property. By using the two kinds of sensors, it is possible for the main body of the recording apparatus to monitor the substrate temperature when the ink is discharged.

Here, as an example of one kind of the temperature sensing element, the diode sensor will be described.

Figure 8:
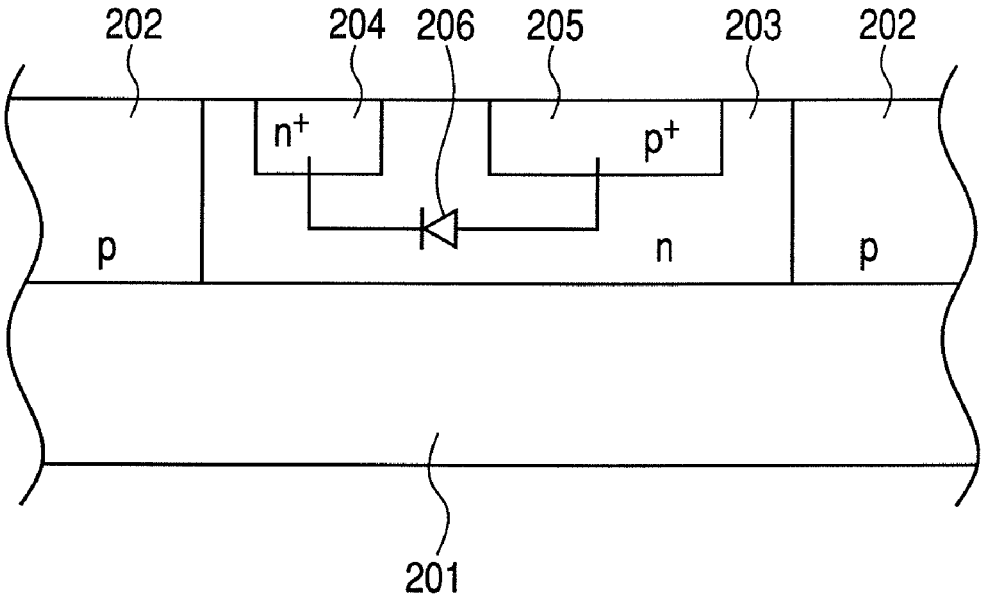
FIG. 8 is a cross-sectional view schematically illustrating a diode sensor.
Figure 9:
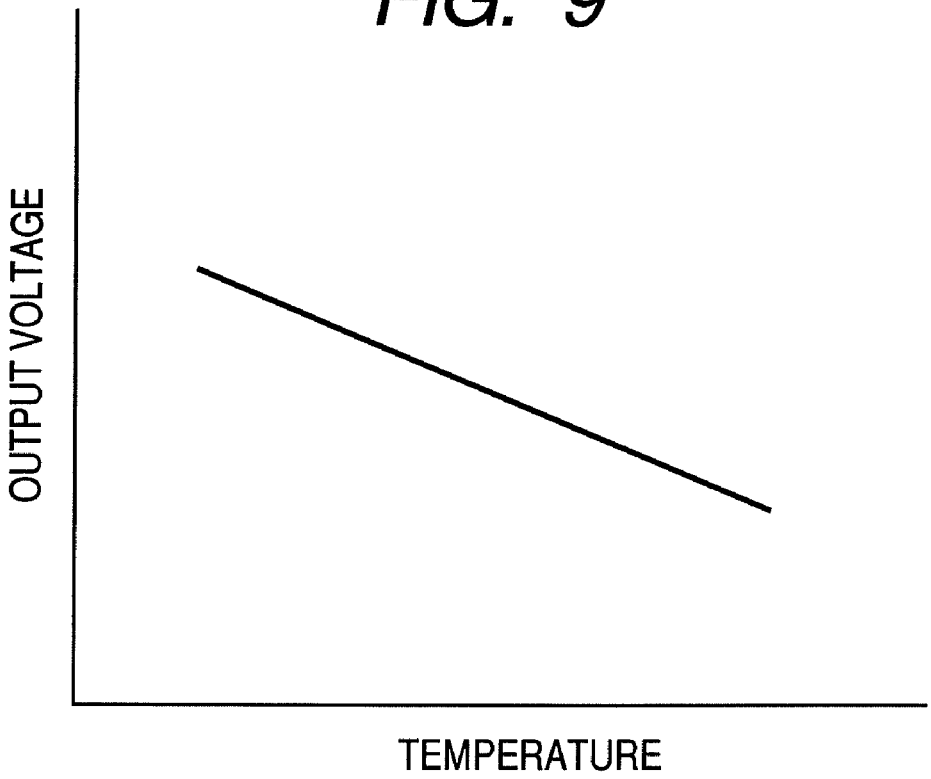
FIG. 9 is a graph illustrating the relationship between change in temperature and an output voltage in applying a constant current to a diode sensor.

The diode sensors 1 and 2 are fabricated as shown in FIG. 8, each of which has a characteristic that the output voltage decreases as the temperature increases in applying the constant current, as shown in FIG. 9.

In addition, as an example of another kind of the temperature sensing element, the aluminum sensor will be described.

Figure 2:
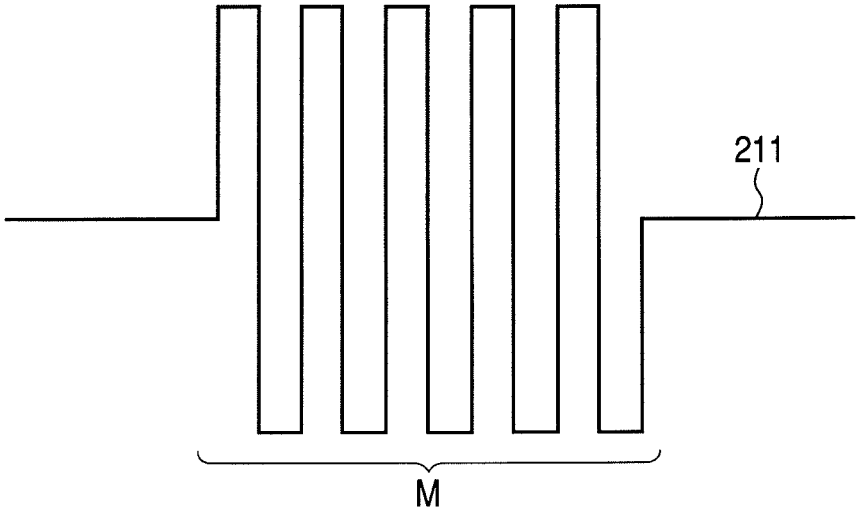
FIG. 2 is a plan view illustrating an example of an aluminum sensor used in the present invention.

As shown in FIG. 2, the aluminum sensors 3 and 4 are configured to increase the resistance value thereof by disposing the aluminum wiring 211 served as a sensor in a meandering shape.

Here, a region where the aluminum wiring is disposed in the meandering shape on an area shown by M in FIG. 2 is defined as an aluminum sensor portion, and the other region is defined as an aluminum wiring portion.

Figure 10:
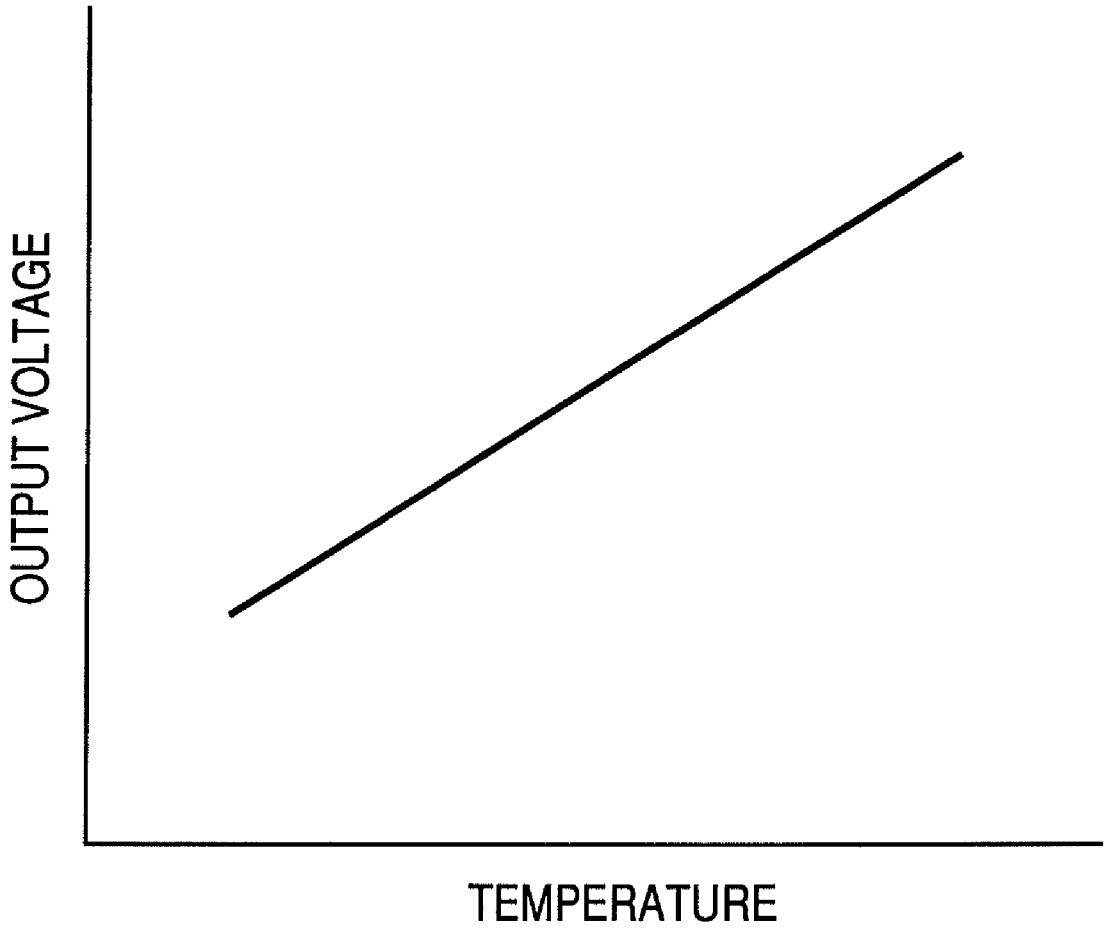
FIG. 10 is a graph illustrating the relationship between change in temperature and an output voltage in applying a constant current to an aluminum sensor.

As shown in FIG. 10, the aluminum sensors 3 and 4 each has a characteristic that the output voltage increases as the temperature increases in applying the constant current.

In the above description, aluminum was described as a material of the sensor. However, the material of the sensor is not limited thereto, and a resistive element capable of using a wiring material such as copper, silver, gold, tantalum, titanium, nickel, and polysilicon as a wiring, or a diffusion resistive element which is fabricated by a doping scheme may be used as the material of the sensor. That is, as shown in FIG. 10, if a material has the characteristic that the output voltage increases as the temperature increases when the constant current is applied, any material can be used.

Comparing the respective sensors, the characteristic of the diode sensor is hardly affected in manufacturing processes, so that the accuracy of the temperature sensing is good and is most suitable for sensing the temperature of the ink jet head.

Also each diode sensor is connected to the input/output pad via the wiring made of aluminum in order to be electrically connected with the outside (not shown in FIG. 1).

The wirings of the diode sensor 1 and the aluminum sensor 3 are connected to the input/output pads 56 on side A in FIG. 1, respectively. In addition, the wirings of the diode sensor 2 and the aluminum sensor 4 are connected to the input/output pads 57 on side B in FIG. 1, respectively.

Here, the displacement of the respective temperature sensing elements which are connected to the input/output pads 56 on side A in FIG. 1 will be described.

The temperature sensing elements which are connected to the input/output pads 56 via the wirings made of aluminum are the diode sensor 1 and the aluminum sensor 3. The diode sensor 1 is disposed on a side near the input/output pads 56, and the aluminum sensor 3 is disposed on a side far away from the input/output pads 56.

By disposing the temperature sensing elements as described above, it is possible to make the distance of the wiring made of aluminum to be shorter in the case of the diode sensor 1 and to be longer in the case of the aluminum sensor 3.

Therefore, when the temperature is sensed by the diode sensor, it is possible to reduce the effect on an output voltage value to be changed in accordance with change in the temperature of the aluminum wiring in applying the constant current. In addition, since the entire resistance value of a sum of the resistance of the aluminum sensor unit and the resistance of the aluminum wiring unit in the aluminum sensor increases, it becomes easy to measure the output voltage value.

Therefore, in the case where the sensor is disposed on a side near the input/output pads 56 in region C which is interposed between the input/output pads 56 and the heater 53 nearest to the corresponding pad shown in FIG. 1, the diode sensor is suitably used. On the other hand, in the case where the sensor is disposed on a region further away from the input/output pads 56 via region C shown in FIG. 1, the aluminum sensor is suitably used.

For the same reason as described above, the temperature sensing element which is connected to the input/output pads 57 on side B shown in FIG. 1 is also configured as follows. The diode sensor 2 is disposed on a side near the input/output pads 57 in region D which is interposed between the input/output pads 57 and the heater 53 nearest to the corresponding pad shown in FIG. 1. On the other hand, the aluminum sensor 4 is disposed on a region further away from the input/output pads 57 via region D shown in FIG. 1.

By disposing the temperature sensing elements as described above, it is possible to sense the temperature of each position on the substrate for the ink jet head with good accuracy.

Figure 3:
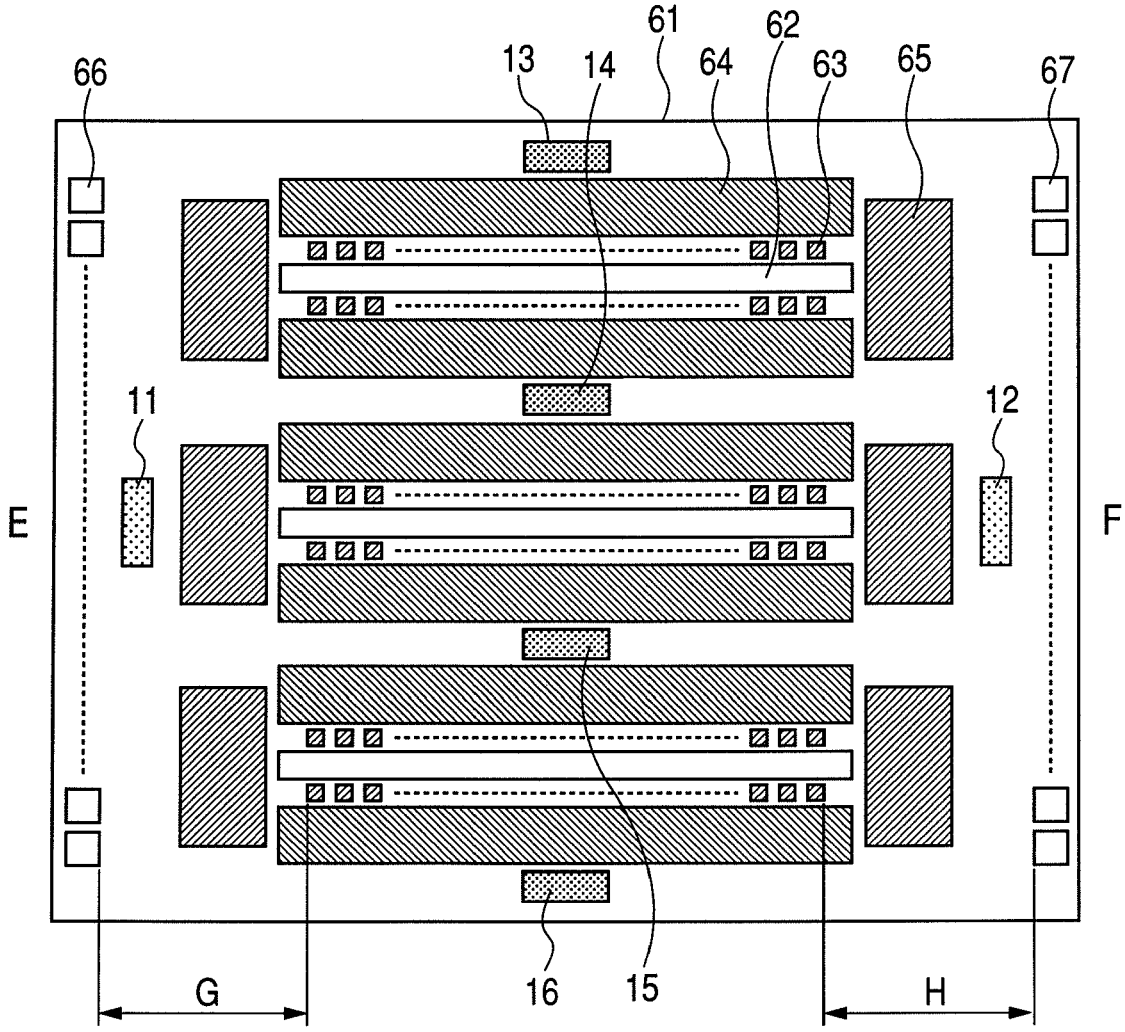
FIG. 3 is a plan view illustrating a substrate for an ink jet head according to another embodiment of the present invention.

FIG. 3 is a plan view illustrating a substrate for an ink jet head according to another embodiment of the present invention.

Each constituent element of the substrate for the ink jet head shown in FIG. 3 is substantially similar to that of the substrate shown in FIG. 1. The configuration of this embodiment is different from that of the substrate shown in FIG. 1 in that a plurality of ink supply ports are disposed on multiple columns in the substrate.

In the configuration shown in FIG. 3, the substrate for the ink jet head 61 includes three ink supply ports 62 each of which is formed as a rectangular through hole, which is extended in a longitudinal direction of the substrate. In addition, a plurality of heaters 63 is disposed on the substrate 61 along the both sides of the ink supply port 62, and the driver units 64, the logic circuit units 65, and a plurality of pads 66 and 67 are provided on the same substrate.

On the substrate 61, there are region G which is interposed between the input/output pads 66 and the heater 63 nearest to the corresponding pad and region H which is interposed between the input/output pads 67 and the heater 63 nearest to the corresponding pad.

The diode sensors 11 and 12 are disposed in regions G and H. In addition, the aluminum sensors 13, 14, 15, and 16 are disposed on a region further away from the input/output pads 66 via region G and a region further away from the input/output pads 67 via region H.

FIG. 3 shows an example of the three ink supply ports 62, but in this embodiment, the number of the ink supply ports may be arbitrary.

Figure 4:
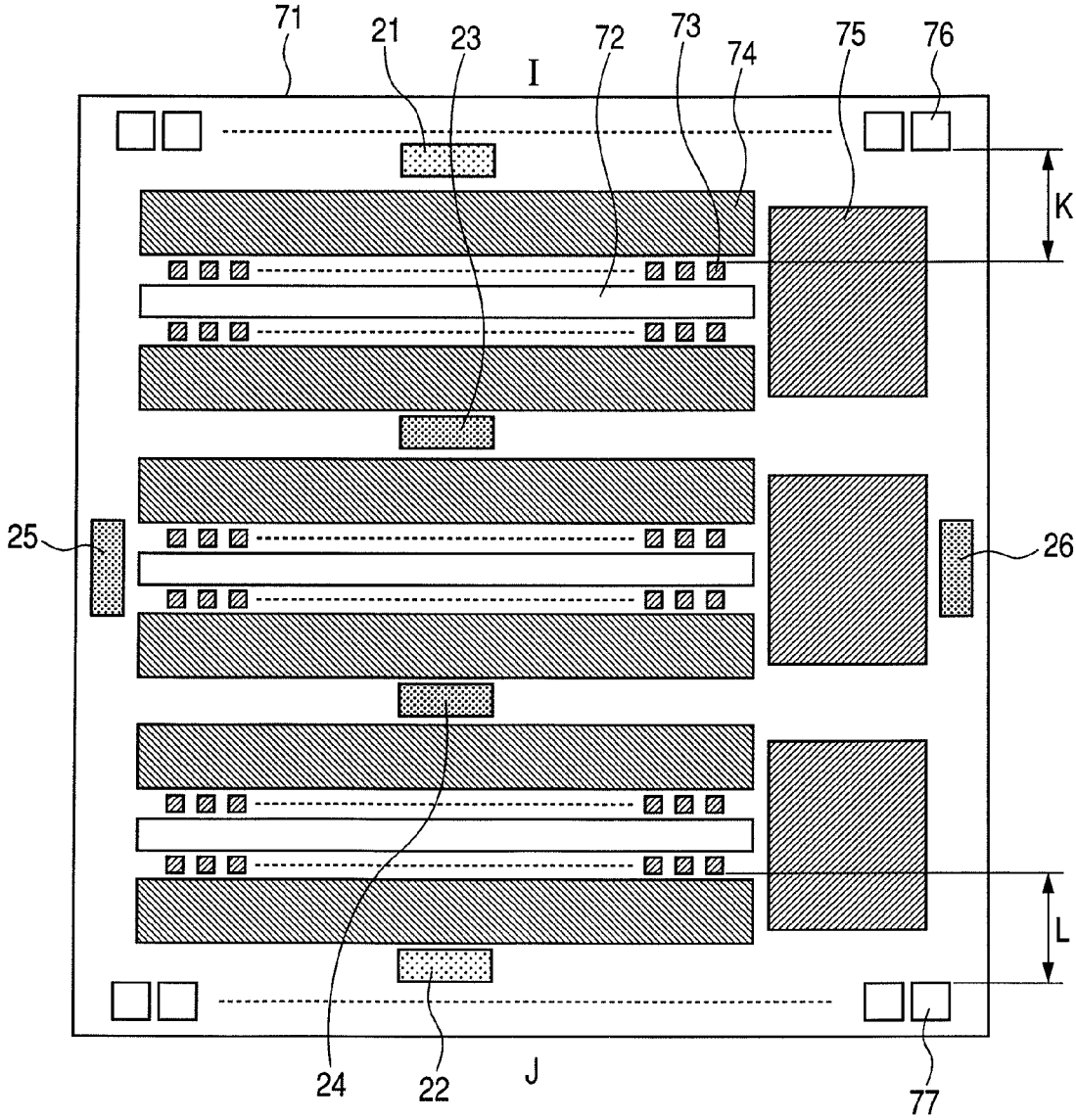
FIG. 4 is a plan view illustrating a substrate for an ink jet head according to another embodiment of the present invention.

FIG. 4 is a plan view illustrating a substrate for an ink jet head according to still another embodiment of the present invention.

In the configuration shown in this drawing, unlike the configuration described above, a plurality of input/output pads is arranged in parallel with the array direction of the heaters.

Referring to FIG. 4, a substrate for an ink jet head 71 includes three ink supply ports 72 each of which is formed as a rectangular through hole, which is extended in a longitudinal direction of the substrate. In addition, a plurality of heaters 73 is disposed on the substrate 71 along the both sides of the ink supply port 72, and driver units 74, logic circuit units 75, and a plurality of pads 76 and 77 are provided on the same substrate.

On the substrate 71, there is region K which is interposed between the input/output pads 76 array on side I in FIG. 4 and the heaters 73 nearest to the corresponding pad array. In addition, there is region L which is interposed between the input/output pads 77 array on side J in FIG. 4 and the heaters 73 array nearest to the corresponding pad array.

The diode sensors 21 and 22 are disposed in regions K and L. In addition, the aluminum sensors 23, 24, 25, and 26 are disposed on a region further away from the input/output pads 76 via region K and a region further away from the input/output pads 77 via region L.

FIG. 4 shows an example of the three ink supply ports 62, but in this embodiment, the number of the ink supply ports may be arbitrary.

(Applications)

Examples which the substrate for the ink jet head of each embodiment described above is applied to the ink jet head and the ink jet recording apparatus will be described.

Figure 5:
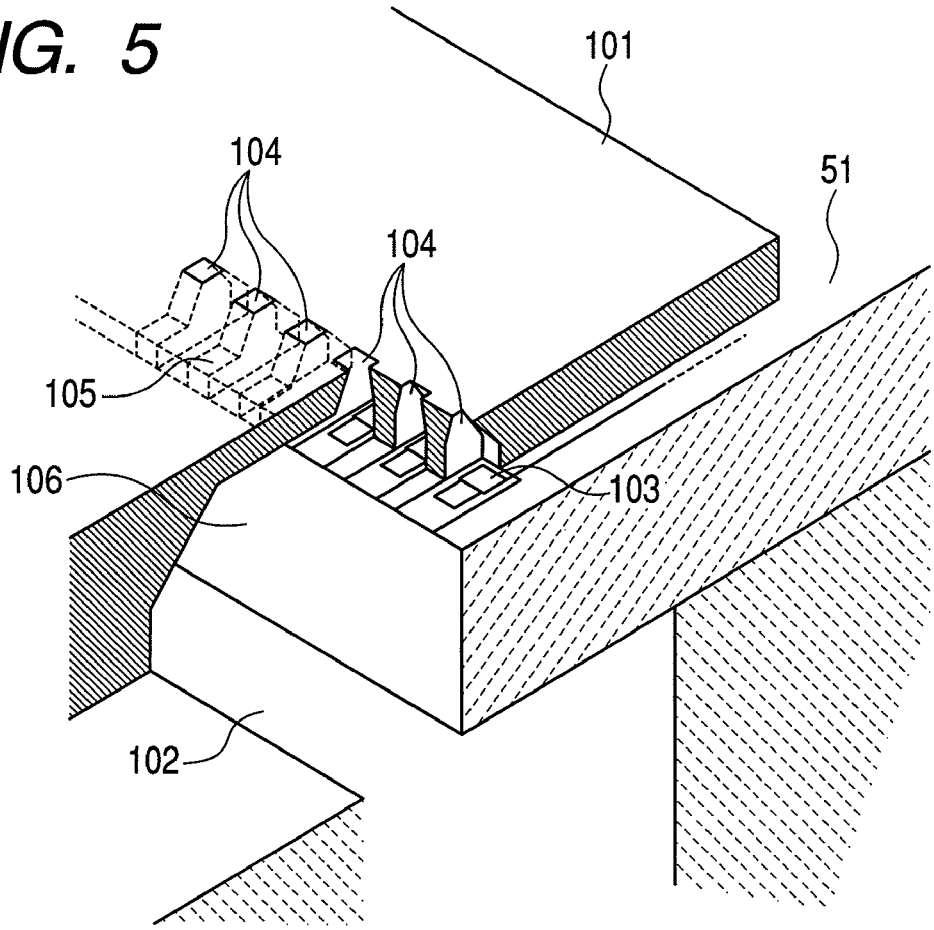
FIG. 5 is a partially cross-sectional view illustrating an ink jet head to which a substrate for an ink jet head of the present invention is applied.

FIG. 5 is a partially cross-sectional view illustrating an ink jet head of the present invention, in which an ink discharging portion is cut out.

As described above, in the configuration shown in FIG. 1, the plurality of the heaters 53 is disposed along the both sides of the ink supply port 52. However, in FIG. 5, only the heater 103 on one side of the ink supply port 102 and the corresponding discharging port 104 are shown for simple description.

As described above, on the substrate 51 for the ink jet head, a plurality of the heaters 103 are arranged in an array shape, each of which generates heat by receiving an electric signal to discharge ink from the discharge ports 104 by bubbles formed by the heat. Channels 105 for supplying ink to the discharging ports 104 provided at positions facing respective heaters 103 are provided corresponding to each of the discharging ports 104.

These discharge ports 104 and the channels 105 are formed on an orifice plate 101. By bonding the orifice plate 101 to the above-mentioned substrate 51 for the ink jet head, a common liquid chamber 106 is provided, which is in communication with the ink supply port 102 and supplies ink to each channel 105.

Figure 6:
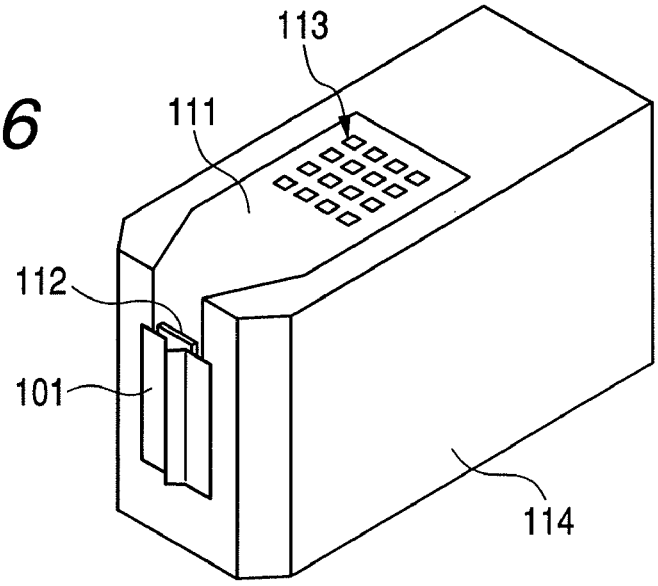
FIG. 6 is a view illustrating an external appearance of an example of an ink jet head of the present invention.

FIG. 6 shows an external appearance of an example of the ink jet head of which a part is shown in FIG. 5. On a TAB tape 111, an electrical connection unit 112 for connection with the substrate 51 for the ink jet head is provided, and a contact pad unit 113 used for connection with the recording apparatus is formed on one end side of the TAB tape 111. The substrate 51 for the ink jet head according to the present invention is disposed on a rear side of the orifice plate 101. After the channels 105 are formed on the substrate 51 for the ink jet head with a dry film or the like, the orifice plat 101 is attached. The fabricated assembly as described above is joined to an ink tank 114 having the TAB tape 111 attached thereon. Then, the electrical connection unit 112 of the TAB tape 111 is bonded with the input/output pad of the substrate 51 for the ink jet head, and the electrical connection unit 112 is sealed by a sealing material to bring the ink jet head to completion.

Figure 7:
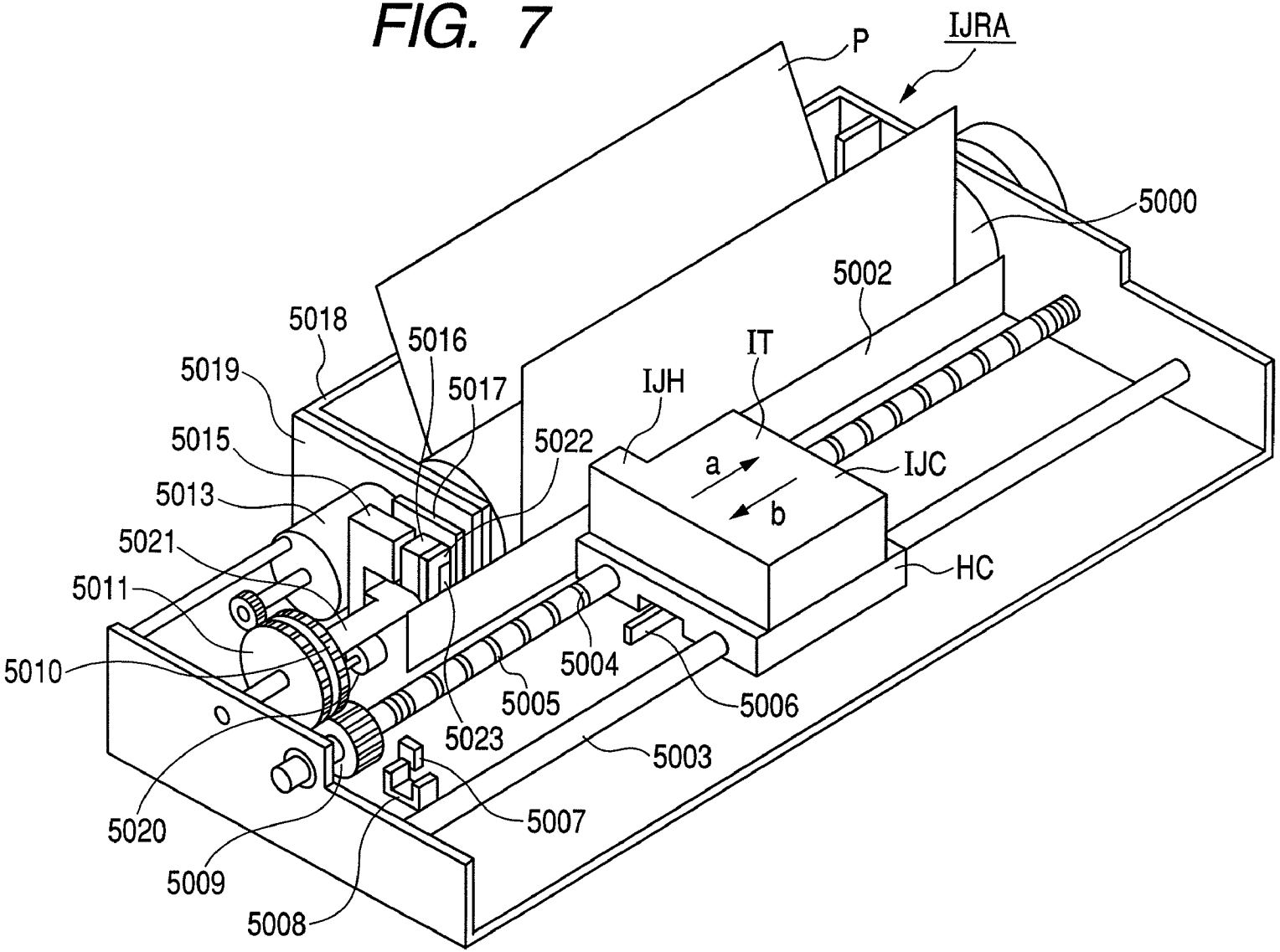
FIG. 7 is a schematic view illustrating an example of an ink jet recording apparatus of the present invention.

FIG. 7 is a schematic view illustrating a configuration of an ink jet recording apparatus IJRA to which the ink jet head of the present invention is applied.

Referring to FIG. 7, a carriage HC, which is engaged with a helical groove 5004 of a lead screw 5005 that is rotated interlockingly with forward reverse revolution of a drive motor 5013 via driving force transmission gears 5009 to 5011, has a pin (not shown). In addition, the carriage HC is reciprocated in directions of arrows a and b while being supported by a guide rail 5003. The carriage HC mounts an ink jet cartridge IJC in which a recording head IJH and an ink tank IT are integrally built. A sheet press plate 5002 is provided, which presses a recording medium P against a platen 5000 over the entire moving direction of the carriage HC. A photo coupler 5007 and 5008 is provided, which is served as a home-position detector for performing switching of the direction of revolution of a motor 5013 by ascertaining the presence of a lever 5006 of the carriage within the above-described range.

A member 5016 is provided to support a cap member 5022 for capping a front surface of the recording head IJH. A suction unit 5015 is provided to suck the inside of the capped portion, and performs suction recovery of the recording head via an opening 5023 in the capped portion. A cleaning blade 5017 and a member 5019 which allows the cleaning blade to move in forward and reverse directions are provided, both of which are supported on a main body supporting plate 5018. The configurations of the blades are not limited thereto, and known cleaning blades may be adapted to this embodiment.

In addition, a lever 5021 is provided to initiate suction for the suction recovery, which is moved in accordance with the movement of a cam 5020 which is engaged with the carriage. A driving force from the driving motor is controlled for this movement via a known transmission mechanism, such as clutch switching or the like.

These capping, cleaning, and suction recovery processing are configured so that desired processing can be performed at a corresponding position by the operation of the lead screw 5005 when the carriage reaches a region at the home position side. Further, if a desired processing is performed at a known timing, the processing can be applied to this embodiment.

In addition, this recording apparatus includes a signal supplying unit for supplying driving signals to drive the heat elements or signals for sensing temperature to the ink jet head (substrate for the ink jet head).

In addition, the ink jet recording apparatus senses the temperatures of the respective temperature sensing elements which are disposed on the substrate for the ink jet head when the temperature of the ink jet head is uniform, for example, at the time of supplying power. Further, the temperatures of sensors other than the diode sensor are matched to the temperature of the diode sensor as reference.

In addition, when the ink jet head is driven, it may be driven by adjusting driving pulses of the heater corresponding to temperature information of the plurality of temperature sensing elements which are provided on the substrate for the ink jet head. As a result, it is possible to perform printing without variation in the image density by adjusting the driving pulses of the heater even though temperature difference occurs in the substrate for the ink jet head.

The printing quality of ink jet recording apparatus according to the present invention has been compared with that of a recording apparatus using a conventional substrate for an ink jet head in which the diode sensor is disposed at a portion far from the input/output pads.

When printing had been performed continuously for a long period of time in a state where the temperature of the head was high, the variation in the image density occurred in the conventional ink jet recording apparatus, but there was no variation in the ink jet recording apparatus of the present invention.

According to the present invention described above, it is possible to perform the temperature measurement on a plurality of places of the ink jet head with good accuracy, and it is also possible to control the droplets minutely in a long ink jet head, so that the printing quality is improved.

The temperature of each sensor is sensed when the temperature of the ink jet head is uniform. Further, the temperatures of the sensors are matched to the temperature of the diode sensor which has high accuracy in temperature measurement, as reference. Therefore, the temperature in the head is able to measure with good accuracy.

In addition, since there are provided with the plurality of sensors which have different output voltage properties, even if one of these sensors cannot be operated by an unexpected cause, it is possible to perform the temperature measurement by other sensors of different output voltage property.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-118411, filed Apr. 30, 2008, which is hereby incorporated by reference herein its entirety.

What is claimed is:

1. A recording element substrate comprising:

a substrate;

a recording element provided on the substrate to generate thermal energy for discharging ink;

a first temperature detecting element provided on the substrate and having a property that the output voltage decreases as a constant current is applied upon increase of the temperature of the substrate as the recoding element generates thermal energy; and a second temperature detecting element provided on the substrate and having a property that the output voltage increases as a constant current is applied upon the increase of the temperature of the substrate as the recoding element generates thermal energy.

2. The recording element substrate according to claim 1, wherein the recording element substrate has a terminal for inputting and outputting a signal to a logic circuit for driving the recording element, and wherein a distance between the first temperature detecting element and the terminal is shorter than a distance between the second temperature detecting element and the terminal.

3. The recording element substrate according to claim 2, wherein the first temperature detecting element is connected to a wiring of the logic circuit.

4. The recording element substrate according to claim 2, wherein the second temperature detecting element is connected to a wiring of the logic circuit.

5. The recording element substrate according to claim 1, wherein the recording element substrate has a terminal for inputting and outputting a signal to a logic circuit for driving the recording element, and wherein the first temperature detecting element is provided between the terminal and the recording element closest to the terminal.

6. The recording element substrate according to claim 1, wherein the first temperature detecting element is a diode sensor.

7. The recording element substrate according to claim 1, wherein the second temperature detecting element detects temperature by using a temperature property of electrical resistance.

8. The recording element substrate according to claim 1, wherein the second temperature detecting element is an aluminum sensor.

9. The recording element substrate according to claim 1, wherein the second temperature detecting element is a sensor using diffusion resistance.

10. The recording element substrate according to claim 1, wherein a plurality of the first temperature detecting elements and a plurality of the second temperature detecting elements are provided.

11. A recording head using the recording element substrate according to claim 1.

12. An ink jet recording apparatus using the recording head according to claim 1.

* * * * *